US011267618B1

(12) United States Patent
DeMatteis et al.

(10) Patent No.: US 11,267,618 B1
(45) Date of Patent: Mar. 8, 2022

(54) ALGORITHMIC CONSTRUCTION OF A PLASTIC BAG

(71) Applicants: Robert DeMatteis, Grass Valley, CA (US); Lindsey Blevin, Eureka, CA (US)

(72) Inventors: Robert DeMatteis, Grass Valley, CA (US); Lindsey Blevin, Eureka, CA (US)

( * ) Notice: Subject to any disclaimer, the term of this patent is extended or adjusted under 35 U.S.C. 154(b) by 248 days.

(21) Appl. No.: 15/706,046

(22) Filed: Sep. 15, 2017

Related U.S. Application Data

(60) Provisional application No. 62/395,534, filed on Sep. 16, 2016.

(51) Int. Cl.

| | |
|---|---|
| ***B65D 33/08*** | (2006.01) |
| ***B65D 30/20*** | (2006.01) |
| ***B31B 70/14*** | (2017.01) |
| ***B31B 70/86*** | (2017.01) |
| *B31B 160/20* | (2017.01) |

(52) U.S. Cl.
CPC ..... *B65D 33/08* (2013.01); *B31B 70/142* (2017.08); *B31B 70/874* (2017.08); *B65D 31/10* (2013.01); *B31B 2160/20* (2017.08)

(58) Field of Classification Search
CPC ..... B65D 33/08; B65D 31/10; B31B 70/874; B31B 70/142; B31B 2160/20
USPC ..... 383/10
See application file for complete search history.

(56) References Cited

U.S. PATENT DOCUMENTS

| | | | | | |
|---|---|---|---|---|---|
| 3,468,470 | A | * | 9/1969 | Sengewald | B65D 31/00 383/10 |
| 3,568,918 | A | * | 3/1971 | Blomqvist | A45C 3/04 383/109 |
| 4,125,220 | A | * | 11/1978 | Suominen | B65D 33/08 383/37 |
| 4,174,657 | A | * | 11/1979 | Suominen | B65D 33/08 156/253 |
| 4,398,903 | A | | 8/1983 | Lehmacher | |
| 4,526,565 | A | | 7/1985 | Hummel | |
| 4,588,392 | A | | 5/1986 | Maddock | |
| 4,609,366 | A | | 9/1986 | Ley | |
| 4,636,191 | A | | 1/1987 | Piggot | |
| 4,717,262 | A | * | 1/1988 | Roen | B65D 31/08 383/104 |
| 4,759,639 | A | | 7/1988 | DeMatteis | |
| 4,877,335 | A | * | 10/1989 | Barnard | B65D 33/065 383/6 |
| 4,906,228 | A | | 3/1990 | Reifenhauser et al. | |
| 4,923,436 | A | | 5/1990 | Gelbard | |
| 4,989,993 | A | * | 2/1991 | Barnard | B65D 33/065 383/10 |
| 5,121,995 | A | * | 6/1992 | Newman | B65D 33/06 383/29 |
| 5,248,040 | A | | 9/1993 | DeMatteis | |

(Continued)

FOREIGN PATENT DOCUMENTS

| | | |
|---|---|---|
| CA | 2145045 | 11/1995 |
| EP | 0147122 A1 | 7/1985 |

(Continued)

*Primary Examiner* — Peter N Helvey
(74) *Attorney, Agent, or Firm* — Advantage IP Law Firm

(57) ABSTRACT

A bag with improved carry handle strength and stand-up ability and method of constructing same using an algorithm that takes into account one or more bag traits resulting in an upper bag portion configuration constructed to carry a predetermined volume of contents within the bag body.

20 Claims, 12 Drawing Sheets

(56) References Cited

U.S. PATENT DOCUMENTS

| | | | | |
|---|---|---|---|---|
| 5,282,687 | A * | 2/1994 | Yee | B65D 75/5833 383/25 |
| 5,338,118 | A | 8/1994 | DeMatteis | |
| 6,186,933 | B1 | 2/2001 | DeMatteis | |
| D784,157 | S * | 4/2017 | Ross | D9/705 |

FOREIGN PATENT DOCUMENTS

| | | | |
|---|---|---|---|
| GB | 2121721 | A | 1/1984 |
| WO | WO/2015031191 | A2 | 3/2015 |

* cited by examiner

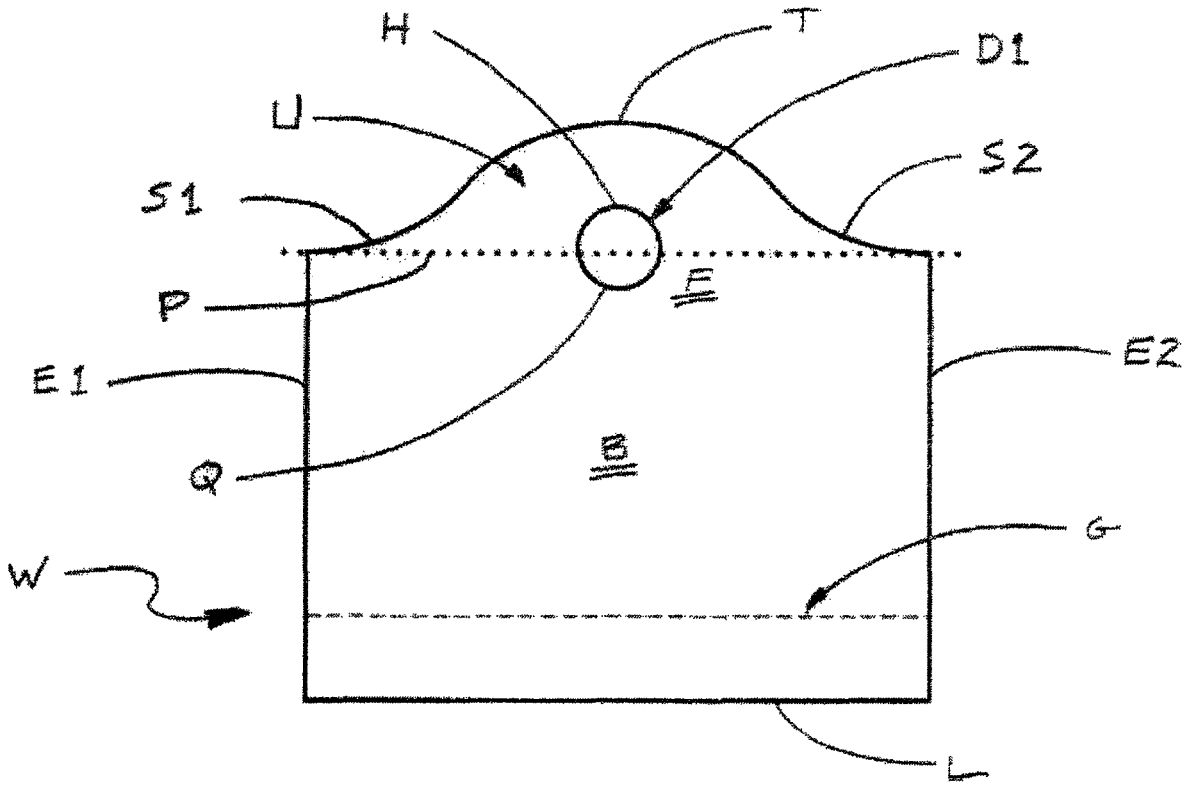
FIG. 1A – Prior art

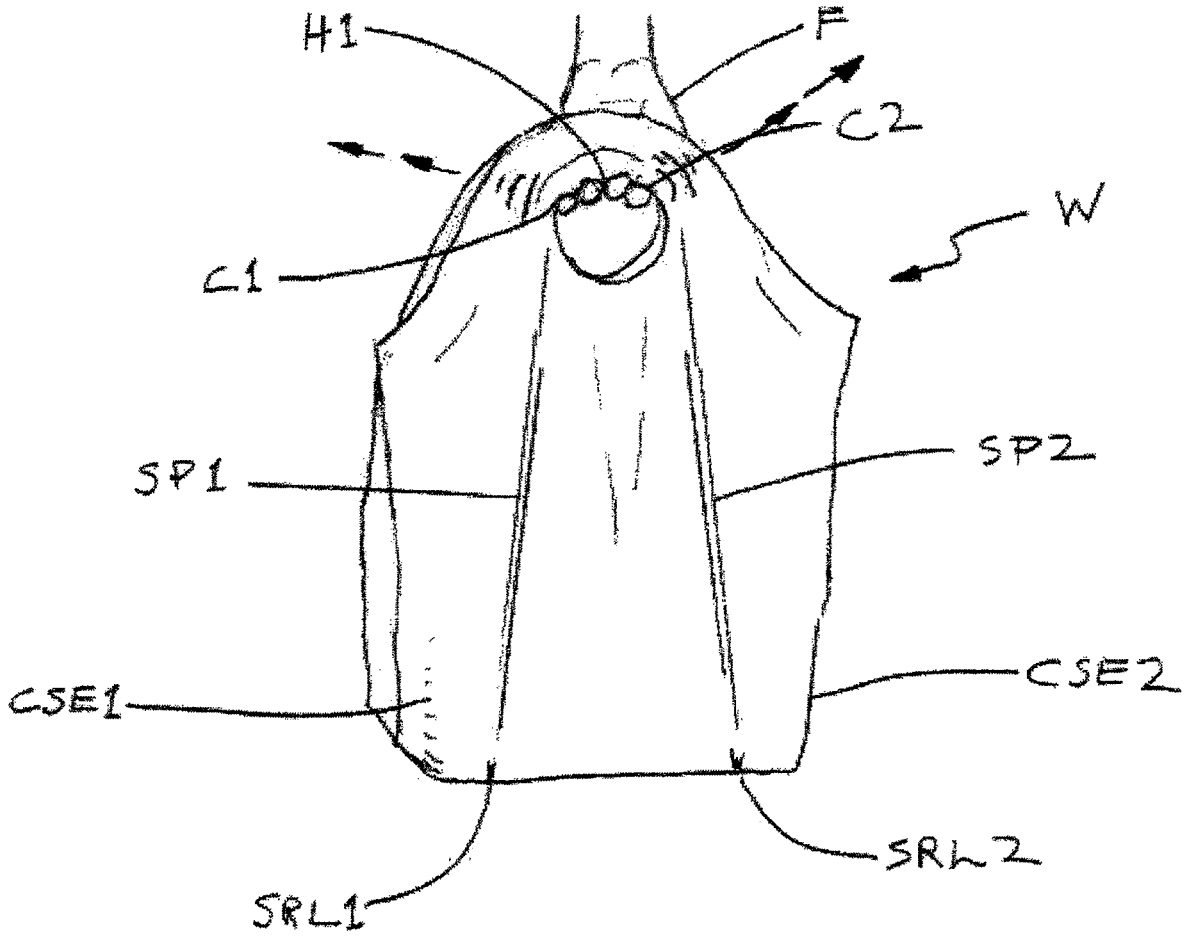
FIG. 1B – Prior art

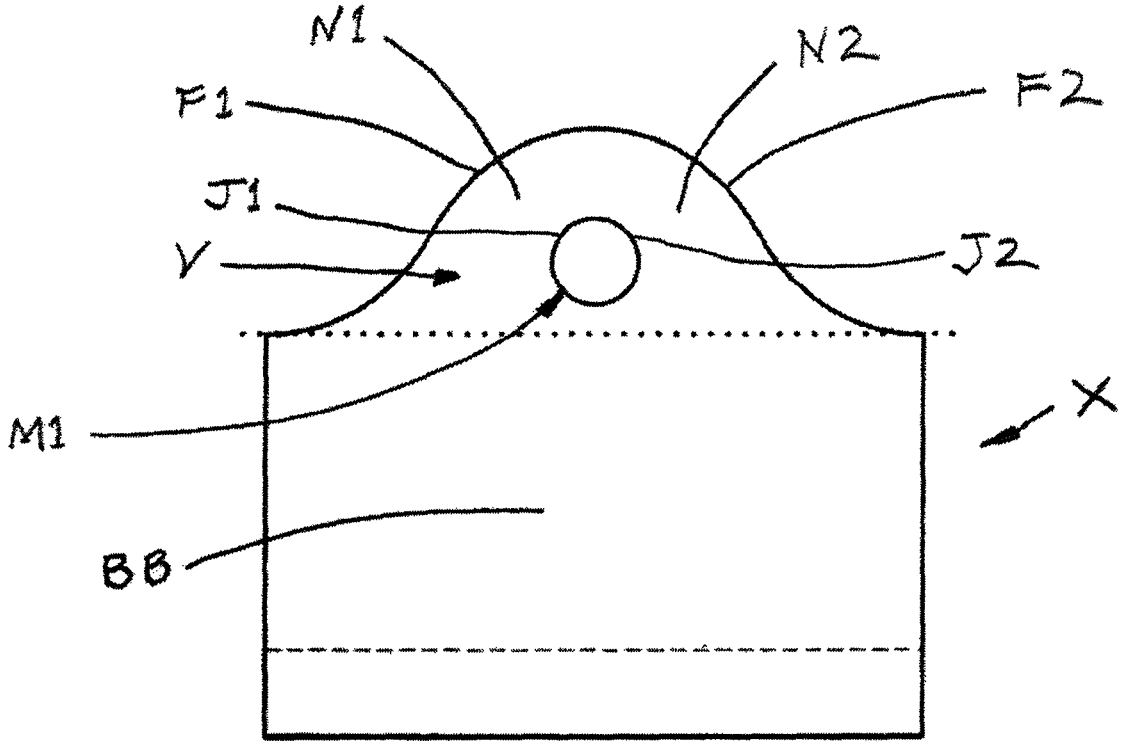
FIG. 1C – PRIOR ART

ALGORITHMIC CONSTRUCTION OF A PLASTIC BAG

CROSS REFERENCE TO OTHER APPLICATIONS

This application claims the benefit of U.S. Application No. 62/395,534, filed on Sep. 16, 2016, entitled Algorithmic Construction of a Plastic Bag, and which is hereby incorporated by reference in its entirety.

BACKGROUND

1. Technical Field

The present invention relates generally to plastic carry bags and the improvement of their functionality. More specifically, it relates to various characteristics that enhance handle strength, assist a bag to efficaciously stand up thus promoting easy use for loading, cooperate with the displacement of stress for carrying, and provide an algorithm to optimize performance.

2. Background

Very little has changed in the manufacture of wavetop (or sinewave) style plastic bags over the past 30 years. In fact, most advances have been related to their manufacturing efficiencies with little regard to functionality. Typical wavetop bags made with a sinusoidal bag top and their manufacturing processes are described in Suominen U.S. Pat. No. 4,174,657, Lehmacher, et. al. GB 2121721A, Ley U.S. Pat. No. 4,609,366, and Roen, et al U.S. Pat. No. 4,717,262. As illustrated throughout these patents, the sinusoidal bag tops have a generally curved top center location where a die-cut handle is punched, and a curved bottom shoulder location adjacent the sealed bag sides. Typically the bottom curved location has an exact opposite upside down curvature equal to ½ of the curved top center location. This simple sinewave style with the curved top center location and curved bottom locations is the preferred bag today as it conforms to the high-speed manufacturing process with a cutting blade (aka, known as a "flying knife") that swiftly weaves in and out as it forms two opposing bag tops as illustrated in the referenced patents. This manufacturing process also eliminates waste. This bag and manufacturing style accounts for essentially all of the wavetop bags made today with perhaps one to two exceptions, depending on the interpretation of the definition of the word "wavetop".

While the '657, '721, '366 and '262 patents relate primarily to manufacturing processes, only the '657 bag also relates to a bag with a stronger handle, whereas a reinforced strip is bonded to the central film region where the wavetop shape is made. Rifenhauser in U.S. Pat. No. 4,906,228 invented a means of thickening a strip of film along a central region in the extrusion operation, whereas the resultant bags have stronger die-cut handles in the wavetop portion.

Another example of a bag top that has a wavelike bag top is described in Lehmacher U.S. Pat. No. 4,398,903 and the Piggot EU 0147122 A1. The '903 is called "somewhat elliptical", but in FIG. 2 the bag illustrated is not elliptical like typical wavetop bags described in the '721, '366, and '262 patents. Nor is the bag illustrated in '122 typical of a wavetop bag. These particular bags have a flat top above a die cut handle with flat shoulders and are also illustrated in FIG. 2 of the '657 patent and referred to a different type of "curve shape". The flying knife used with the '903 style of bag would be required to make four changes in direction to form this type of bag top, instead of the two changes in direction with bags made in the faster, more efficient process used in the '721 patent.

As cited in the '903 patent on page 5 in the right column on line 26, the paragraph discusses how "the peripheral speed of the cutting drum forms a direct relationship with the rotation rate for upstream and downstream feed rollers (and feed speed)". It is commonly known in the industry that the primary factor determining the bag making cycle speed is based on feed speed, in other words, how fast the flying knife can cut the film in its central location. Thus, the cycle speed is decreased by each change of direction, or requirement thereof. The bag designs as shown in FIG. 2 of the '903 patent and in the '122 patent is not being manufactured today most likely due to the slower bag making process. While there could be some advantages to this style of bag top design if properly engineered, it has not been pursued, nor considered, as its pursuit fell in disfavor of the easier sinusoidal wavetop version of the '721 variety.

Another bag with a somewhat sinusoidal top is more commonly referred to as a Bell bag due to the top being more bell-shaped. Various examples of this design are illustrated in U.S. Pat. Nos. 4,759,639, 5,248,040, and those made by the process cited in U.S. Pat. No. 6,186,933. In these bags, their tops have shoulders made from die cuts, and are not sinusoidal. The '639 bag shoulders are a result of a dispensing operation (removal from tabs), and another bag, the WO 2015/031191 bag has shoulders with valleys that help promote standing up a bag.

All in all, the prior art bag tops regardless of shape, are designs related to various elements of manufacturing and dispensing efficiencies. With the one exception of the '191 bag's valleys, the prior art bag tops are engineered and manufactured with little or no regard to their ability to cooperate with the bag bottom to improve the ability of a bag to stand up, nor do they consider handle strength, ability to fold over a handle, the ease of filling a bag with goods, functionality when loaded, stress displacement, and so on.

To illustrate stress displacement, Maddock U.S. Pat. No. 4,588,392 and Dobreski CA 2,145,045 illustrate stress relief zones where the gussets meet on the bottom of a bag. What is learned from these two patents is that there are two key bottom locations vulnerable to stress when a bag is loaded. The purpose of these inventions is to relieve the stress at these two most vulnerable locations. It exemplifies that stress on a bag when loaded with goods is not directly below the location of a bag handle, but is typically located in two outwardly bottom locations instead. This phenomenon is commonly seen in loaded bags filled with a variety of goods, such as bags used in supermarket and discount store applications.

To further illustrate the two outer stress locations on bags, Gelbard in U.S. Pat. No. 4,923,436, provides a method of manufacture that moves vulnerable slit seals away from the center side gusset creases, where stress tends to be located on bags filled with a variety of goods.

Another functional attribute of prior art is related to the flattening of bag bottoms to improve the ability of a bag to stand up. For example, prior art '657 and '262 bags have bottom gussets that serve as bag bottoms. Inventor Hummel in U.S. Pat. No. 4,526,565 illustrates the use of "parallel" angle seals (FIG. 2) to form a flat bottom in a side-gusseted bag. Angle seals are also used in various types of bulk sacks to package generally granular contents, some of which angle seals would be considered located in a bottom gusset, and in the case of a valve bags with both ends sealed, they would also be located in a top gusset. In the myriad of uses, the bottom gusset size and configurations, with or without the angle seals, and the size of the flat bottom on the side-gusseted '565 bag, are all based on one of two criteria. First, a bottom gusset or flat bottom is sized based on the specific contents it is configured to hold. For example, the size and shape of a hamburger, with a French fry package placed along side. Or second, the bottom gusset size is based on squaring out a bag, such as a bulk bag, so they may be evenly stacked on a pallet facilitating the ability to stack two to three pallets. For example compost, garden soils, bulk chemicals, and so on. Normally these types of bulk sacks have narrow bottom and top gussets. The first criteria shapes the bag size to a given set of products it will be holding, such as the hamburger, fries, or perhaps a similar sandwich or snack box. The second criteria shapes the bags in order to optimize the bag's cube and improve evenly stacking the bags on pallets.

Apart from the lower outer stress regions of bags filled with assorted goods, there are also two stress locations in a single die-cut handle under load as illustrated in FIGS. 4a and 4b in U.S. Pat. No. 5,338,118. As cited, the two stress locations are in the 10:00 and 2:00 location on the die-cut handle. It is interesting to note that bag manufacturers over the years have solely considered die cut handles as having only a singular stress point at the top center location (12:00 location). For strength tests to determine a break point, it has been commonplace to hang a bag on a hook or rod, and pull downward forcefully on the bag body until the handle breaks. This approach has been commonly applied to wave top bags with their round handles. However, the shapes of a human's hands are not round like poles.

As illustrated herein, plastic bags have been made with various types of upper structures and die-cut handles for years, and all prior art designs demonstrate deficiencies of one form or another. Whether that deficiency affects handle strength, the ability of a handle to fold over, the bag's ability to stand-up for loading goods, avoids the two true stress points at the 10:00 and 2:00 location, or overlooks the outer stress regions on a bag bottom, no prior art design incorporates most, or all, of these desirable attributes in one design, let alone a formula or algorithm to accomplish the desired objective.

A bag top design that optimizes handle strength, in which the upper handled portion is easy to fold over to allow easy access to load goods, and when loaded, encourages the bottom portion of the bag to square out and stand up when filled, that likewise cooperates with the two stress points at the 10:00 and 2:00 locations of a die-cut handle and the two outer stress locations adjacent the bottom, would be valuable to this trade. It would be of additional value should this design have a formula or an algorithm that may be used by manufacturers to easily produce the desired outcome. Last, it would also be of value to have a manufacturing process to minimize waste.

SUMMARY

The embodiments constructed in accordance with the principles of the present invention overcome many of the deficiencies of prior art wavetop bags and provides an algorithm that takes into account one or more preferred bag construction traits for producing a bag structure that optimizes handle strength and promotes ease of folding over the upper handled portion. The bags may be efficaciously used to load and carry a variety of goods, while promoting their ability to stand up. The present invention's structure capitalizes on the displacement of stress at the most vulnerable handle and bottom region locations. Furthermore, it provides a process of manufacturing the same, including a means of total automation.

More specifically, the embodiments constructed in accordance with the principles of the present invention may incorporate: 1) an upper portion structure that provides more material strength of a die-cut handle located therein; 2) an upper portion that is structured with shoulders that promote its ability to fold down and out of the way, thereby providing access to the bag mouth opening for easier loading; 3) an upper portion that also cooperates with a bottom region to promote "squaring out a bag bottom", and; 4) stress displacement locations in its die-cut handle and at the two typical stress reception locations (SRLs) in the bag bottom.

The upper portion of at least one embodiment constructed in accordance with the principles of the present invention may be designed with a flattened, wider top that provides more plastic material at the 10:00 and 2:00 handle stress points (HSPs) thereby optimizing the strength of a die-cut handle when carried in a user's hand. The die-cut handle constructed in accordance with the principles of the present invention may be placed closer to the top of the bag, which when compared to a wavetop bag, reduces the amount of raw material required in order to have comparable handle strength. The bag is also somewhat more comfortable to carry, since the extra material directly above a traditional wavetop bag's die-cut handle bunches up in the user's hand, whereas in the embodiments constructed in accordance with the principles of the present invention the extra material is towards the upper side edges of the top handle region. Moving the die-cut handle upward provides more usable capacity in the bag body, which is unlike a wavetop bag that requires the die-cut handle to be placed lower down on the upper portion, which then typically cuts into the bag body.

Complementing the flattened, wider top, the upper bag portion may also include flattened shoulders adjacent each side seal that are proportionally engineered to encourage the upper bag portion to fold down and out of the way in a desired location based on the bag bottom size. Folding the upper portion down and out of the way provides greater access to the bag mouth opening and is more versatile and able to be filled with a variety of goods. This upper portion structure also promotes the bag's ability to stand up, especially after it is filled with goods. It is important to note that not just any type of flattened top bag or one with shoulders will accomplish this desired outcome. In fact, the prior art bags do not teach this subject matter by illustration, reference, or inference.

Additional unique principles behind the effectiveness of the embodiments constructed in accordance with the principles of the present invention are based on having an upper portion that is correctly proportioned to the size of the bag bottom, or bag bottom gusset, and sufficiently tall enough to be easily foldable. The wider top region on the upper portion with its extra plastic material at the 10:00 and 2:00 locations adjacent the die-cut handle cascades downward with generally steeper middle edges than traditional sinewave bags, then swiftly turns horizontal into two outer flattened bottom edges (horizontal shoulders), whereby foldability is improved.

As will be illustrated, the flattened shoulders are preferably one-fourth to one-half the width of the gusset. When correctly proportioned, the bags constructed in accordance with the principles of the present invention not only stand up better, with handles that easily fold down, but such proportionality inherently positions the two handled stress points in a desirable juxtaposition with the two bottom stress points. This proportional design also creates an attractive appearance, one that "looks right".

It is automatically assumed that paired handles like those on most plastic bags must be serviceable by users. Regardless of bag size, capacity, and bottom gusset area, the handles must meet in the top middle location in order for a user to comfortably carry the bag with one hand. It goes without saying that if a bag's handles are too short to span over the open mouth of the bag to meet and cover the contents, then it is not serviceable to carry a full load, or would require two hands to carry the bag; in other words, one hand on each individual handle. This is frequently the case with wavetop bags, loop handled shopping bags, and even handled paper bags. But unlike the prior art, the die-cut handle structure of the bags constructed in accordance with the principles of the present invention will easily reach across the bag mouth and comfortably carry a full load.

Methods of constructing a flat topped bag using an algorithmic approach are also discussed herein.

All of the embodiments summarized above are intended to be within the scope of the invention herein disclosed. However, despite the discussion of certain embodiments herein, only the appended claims (and not the present summary) are intended to define the invention. The summarized embodiments, and other embodiments and aspects of the present invention, will become readily apparent to those skilled in the art from the following detailed description of the preferred embodiments having reference to the attached figures, the invention not being limited to any particular embodiment(s) disclosed.

BRIEF DESCRIPTION OF THE DRAWINGS

FIG. 1A is a front view of a typical prior art wavetop bag, the rear view being identical.

FIG. 1B is a perspective view of the bag in FIG. 1A filled with goods and illustrating the two stress locations on the die-cut handle and the two stress reception locations (SRLs) at the bag bottom.

FIG. 1C is a front view of another typical prior art wavetop bag with an extended upper portion in order to assist in its to have usable handles and the ability of the upper portion to fold over, the rear view being identical.

FIG. 3AA is a blown-up view overlay of the bags in FIG. 3A illustrating the differences in handle strength.

DETAILED DESCRIPTION

Figure 2A:
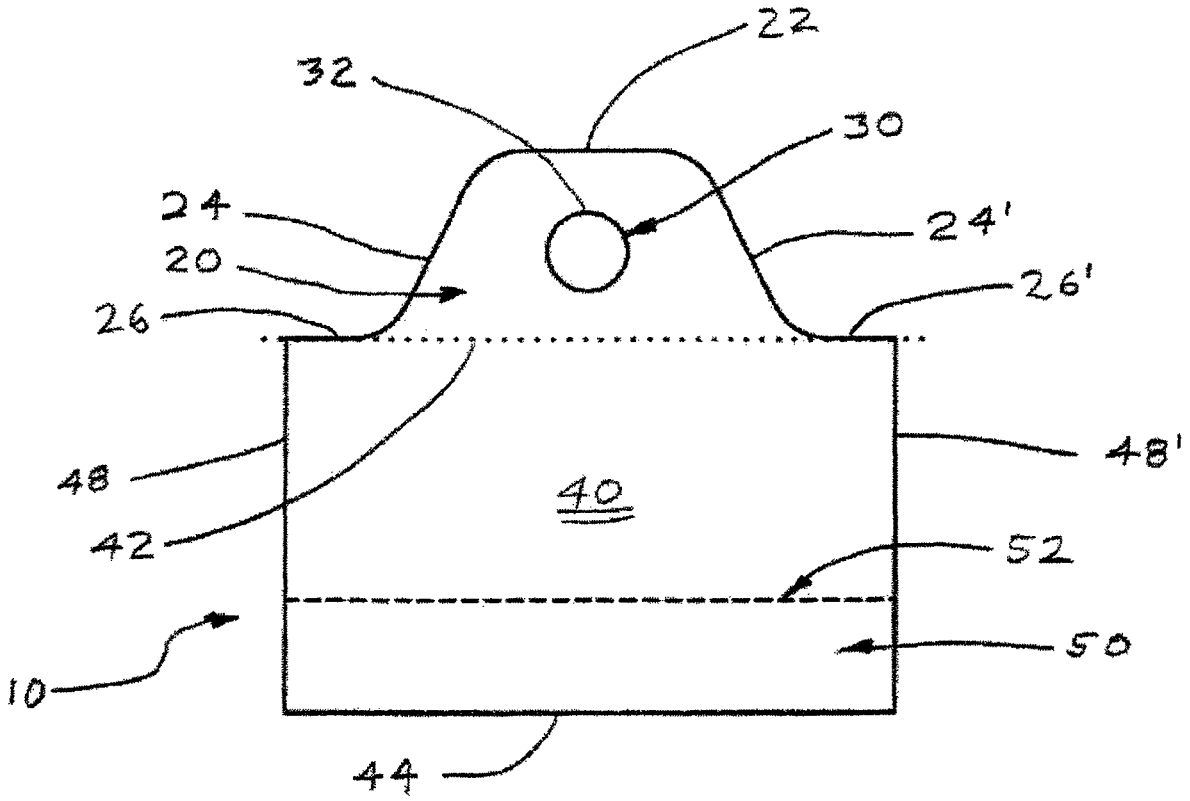
FIG. 2A is a front view of an exemplary embodiment of a plastic bag constructed in accordance with the principles of the present invention depicting its upper portion in relation to bag size and bottom dimensions, the rear view being identical.

In FIG. 1A, a prior art wavetop bag W has a sinusoidal upper portion U defined by bag top T, two outer shoulders S1 and S2 ending at side sealed edges E1 and E2, a die-cut front panel handle D1 and a die-cut rear panel handle D2 (not shown) positioned one atop the other, and a bag body B defined by a bottom L, two side edges E1 and E2 and a body top P (dotted line) that also defines the bag mouth between the front and rear panels that extends across the entire front and back panels to the two outer side sealed edges E1 and E2 through which goods may be inserted into the bag body B and set on the bottom L or atop one another. In FIG. 1A, the back or rear panel is not shown but is assumed to be constructed the same as the front panel shown and sealed to the front panel at side edges E1 and E2. Such a bag W is typically used to carry common household goods and groceries would typically measure 17" wide×19" tall, with a 5.5"-6" bottom gusset G measured upwardly from the bottom L of the bag body B. The upper portion U extends above bag body B by around 3.5" to 4" measured upwardly from the body top P. The top H of the die cut handle D1 is typically located about 2½" to 3" below bag top T providing sufficient plastic material above the die-cut in order to give sufficient strength to the handle. The die-cut handle top H of die-cut handle D1 on a typical wavetop bag is where it is carried by an end user's hand and is only about 1" to 1.5" above body top P (the bag mouth) of bag body B. The lower portion Q of die-cut handle D1 therefore cuts across and below body top P. It is clear that should this bag structure be filled full, the handles are inadequate to reach across the bag mouth and carry the goods without utilizing at least a portion (1.5"-2") of the upper bag body film F thus reducing the usable capacity in bag body B. It is also apparent that the 3.5"-4" upper portion U would be difficult to fold over, and would be of little use in helping load the generally taller, narrow bag configuration, let alone be able to place goods in the bottom of the bag.

In FIG. 1B, the bag in FIG. 1A is held by a shopper's hand F and filled with goods, but not packed full, due to the short span of die-cut handle tops H1 and H2 (not shown) not being long enough to reach across the bag mouth, which is 5.5" wide, the equivalent of the width of the bag bottom. FIG. 1B illustrates that when a bag is under load, there are two handle stress points (HSPs) at the upper outer corners of the die-cut handle at the 10:00 and 2:00 locations C1 and C2 respectively. A human hand inserted into any die-cut handle creates two stress points at the 10:00 and 2:00 locations, whereas it is commonly thought of in the trade as having a single stress point located at the 12:00 location. When a stronger handle is required, the typical approach in the prior art would be to place it further down from the bag top so there is more plastic above the handle.

With bag W under a load, such as when filled with a volume of goods, FIG. 1B also illustrates the two corresponding stress reception locations (SRLs) at the bag bottom. It is interesting to note, that when a bag is filled with a heavy load, the location of the SRLs are invariably located ⅙ the distance in from the sides of a cubed-out bag. As shown, SRL1 is located about ⅙ the distance in from cube side edge CSE1, and SRL2 is located about ⅙ the distance in from cube side edge CSE2. For example, with bag W, the cube size would be 11.5" on the face, with 5.5" sides, ⅙th of the 11" face puts an SRL in from the CSE1 and CSE2 sides 1.8333" or a little more than 1 13/16". Regardless of bag size and bottom gusset configuration, this formula generally holds true with most bags filled more or less full with assorted goods. A bag slightly under loaded would put the SRLs further toward the center of the bag's face. If a bag is loaded with goods that are wider than the face, SRLs tend to be pushed outward.

As illustrated, the stress lines SP1 and SP2 in the plastic film connect the two die-cut handle stress points C1 and C2 with the lower SRL1 and SRL2 and form an A-shape appearance. As will be illustrated in more depth in the following figures, the major stress put on die-cut bag handles under heavy load, or bags that are continually reused, is generally speaking, somewhat perpendicular (arrows) to where the stress lines SP1 and SP2 meet at handle stress point (HSP) locations C1 and C2. In other words, to strengthen a die cut handle requires more film in the 10:00 and 2:00 locations, and not at the center bag top, as is commonly applied.

In FIG. 1C, another prior art wavetop bag X has an extended upper portion V in order to move die-cut handles M1 and M2 (rear panel, not shown) upward to allow them to reach across and carry a full load. Likewise, the extended height promotes the ability of upper portion V to fold over as is desirable to facilitate loading goods into bag body BB. As illustrated, the extended upper portion has a height of 6" compared to bag W in FIG. 1A with its 4" height. However, in accommodating these two highly desirable attributes, the amount of plastic N1 and N2 becomes thinner making handles M1 and M2 weaker at the two vulnerable 10:00 and 2:00 HSP locations; between die-cut handle stress points J1 and J2 and outer edges F1 and F2. This thinning of the plastic material will be illustrated more accurately in FIG. 3. Thus, it is clearly detrimental to the bag structure's performance and effectively makes this bag impractical for heavy or even moderate loads, and more impractical for multiple uses as durability is severely affected.

As discussed herein, it is essentially impossible to create a longer foldable handle to reach across a wider bag bottom on a traditional sinewave (wavetop) bag configuration without sacrificing handle strength. Then again, when the sinewave is shortened, the upper portions don't fold effectively and when the die cut handle is made strong enough for heavy loads, it cuts downward into the bag body, thereby sacrificing usable capacity.

In FIG. 2A, a bag, generally designated 10, constructed in accordance with the principles of the present invention is non-sinusoidal (as compared to the prior art wavetop bags W and X in FIGS. 1A and 1C above, respectively) with an upper portion 20 defined by flattened bag top 22, two opposing steepened side perimeters 24 and 24' that curve outwardly from the flattened bag top 22 to transition into two sets of opposing flattened (or horizontally projecting as viewed in FIG. 2A) shoulders 26 and 26' with outermost ends that abruptly end at the uppermost end of sealed side edges 48 and 48', respectively, of a bag body 40. Upper portion 20 has two die-cut handles 30 and 30' (rear panel, not shown) positioned one atop the other. Upper portion 20 is integrally connected to a bag body 40 whose upper boundary (the body top) is defined by flattened shoulders 26 and 26' and thereby connected in between, as illustrated by horizontal dotted line 42, also corresponding with the bag mouth leading into the bag body 40. At the bottom of bag body 40 are two bag bottom edges 44 and 44' (rear panel, not shown) aligned atop one another, which two edges are interconnected by a bottom gusset pleat 50 defined by center gusset crease indicated by dashed line 52. While the rear or back panel, including both upper portion and bag body, is not shown in FIG. 2A, the construction is the same as the illustrated front panel.

While the bag 10 may be used in a wide variety of sizes for different applications, for purposes of explanation, only a bag that is size-appropriate to pack common household goods and groceries is discussed herein. Such a bag would typically measure 19" wide×18" tall, with a 7" bottom gusset. The flattened bag top 22 of the upper portion 20 extends above bag body 40 by 6" as measured from the dotted line 42, with the top 32 of the die-cut handle 30 located 2" below flattened bag top 22, and about 4" above bag body top 42. With this 4" distance above bag body top 42 it is easy to see that when a full bag is carried by an end user, die-cut handles 30 and 30' (FIG. 2B) will easily reach across the 7" width, with an inch to spare. It is also easy to see that this taller upper handle portion 20, coupled with the flattened shoulders 26 and 26' will more willingly fold over and out of the way, thus facilitating loading with clear access to the bag bottom. As will be illustrated in FIG. 4A, the upper portions 20 and 20' (rear panel, not shown) willingly fold over at, or just above, the bag body top 42.

Figure 2B:
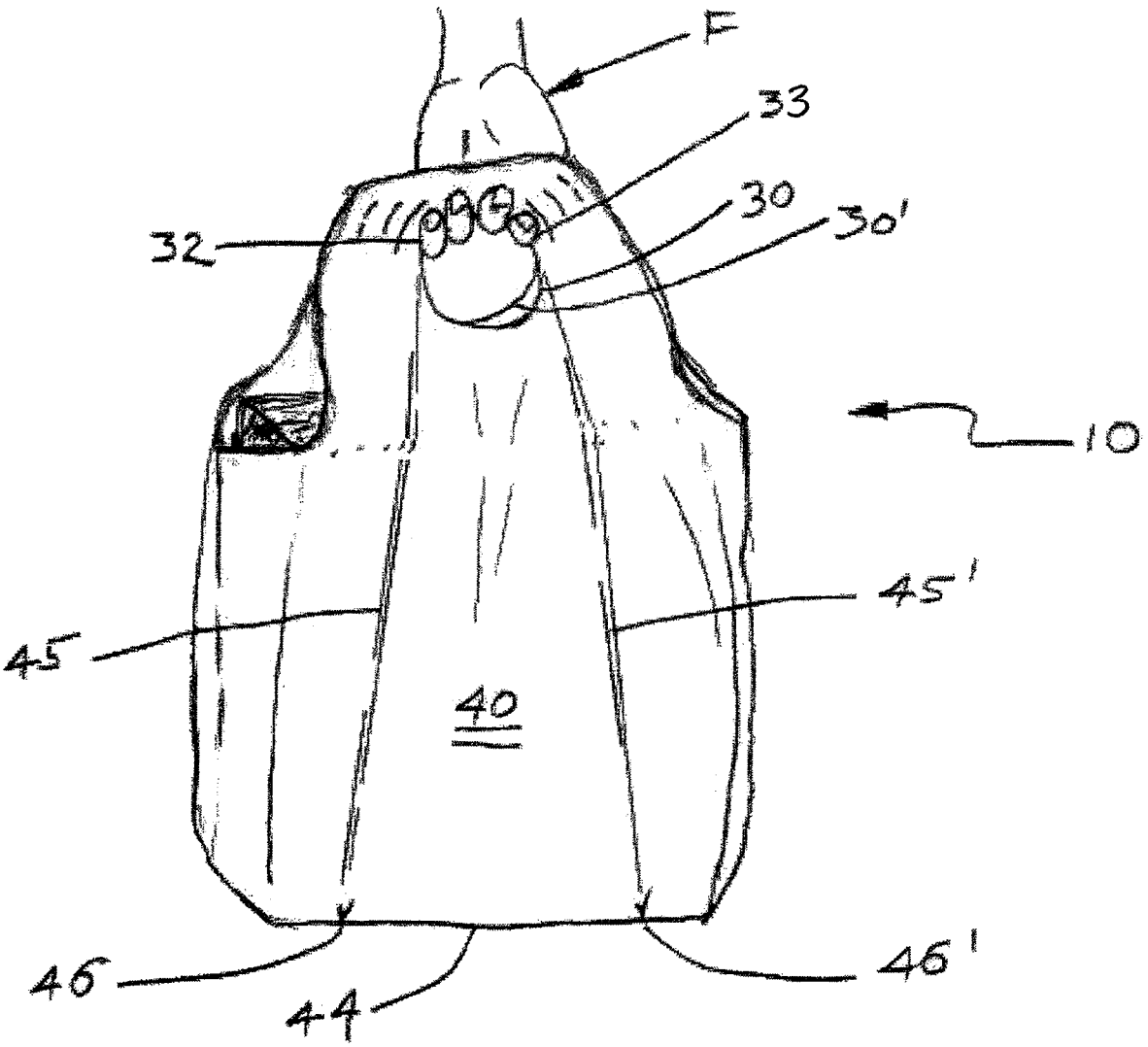
FIG. 2B is a perspective view of the exemplary embodiment shown in FIG. 2A filled with goods and illustrating the relationship between the two handle stress point (HSP) stress locations on the die-cut handle and the two SRLs at the bag bottom.

In FIG. 2B bag 10 of FIG. 2A is loaded full with goods and with a user's hand F inserted in die-cut handles 30 and 30'. As illustrated, the bag handles reach across the bag mouth, and like prior art bag W there are the two HSP locations on each die cut handle at 32 and 32' (not shown, located on die-cut handle 30') and 33 and 33' (not shown, located on die-cut handle 30') at the 10:00 and 2:00 locations respectively. The two stress lines 45 and 45' start at handle locations 32 and 33 and reach downward and outward across body face 44 of bag body 40 and connect to the two SRLs 46 and 46' located at bag bottom 44, and form more or less the same A-shaped pattern, although slightly distorted by the bag contents. Once again, this depicts the concentration of stress on each die-cut handle and the direct connection with the need to have sufficient plastic adjacent HSP locations 32 (and 32' on die-cut handle 30') and 33 (and 33' on die-cut handle 30'). It is important to note that in the bags constructed in accordance with the principles of the present invention, the amount of plastic located outward in a generally perpendicular disposition (arrows) from all HSP locations 32 and 32', and 33 and 33', is inherently wider due to the nature of the non-sinusoidal upper portion configuration, and is more clearly illustrated in FIG. 3A.

Overall, the configuration of the bag 10 illustrated in FIGS. 2A and 2B tends to be made wider and squattier, whereby it can be loaded fuller. The longer handles of the bag 10 allow the handles to be folded down and for the entire bag capacity to be filled and, more importantly, to subsequently be carried afterward with a single hand. Thus, unlike the prior art, 100% of the capacity of bag body 40 constructed in accordance with the principles of the present invention is considered usable capacity and may then be carried with a single hand.

Figure 3A:
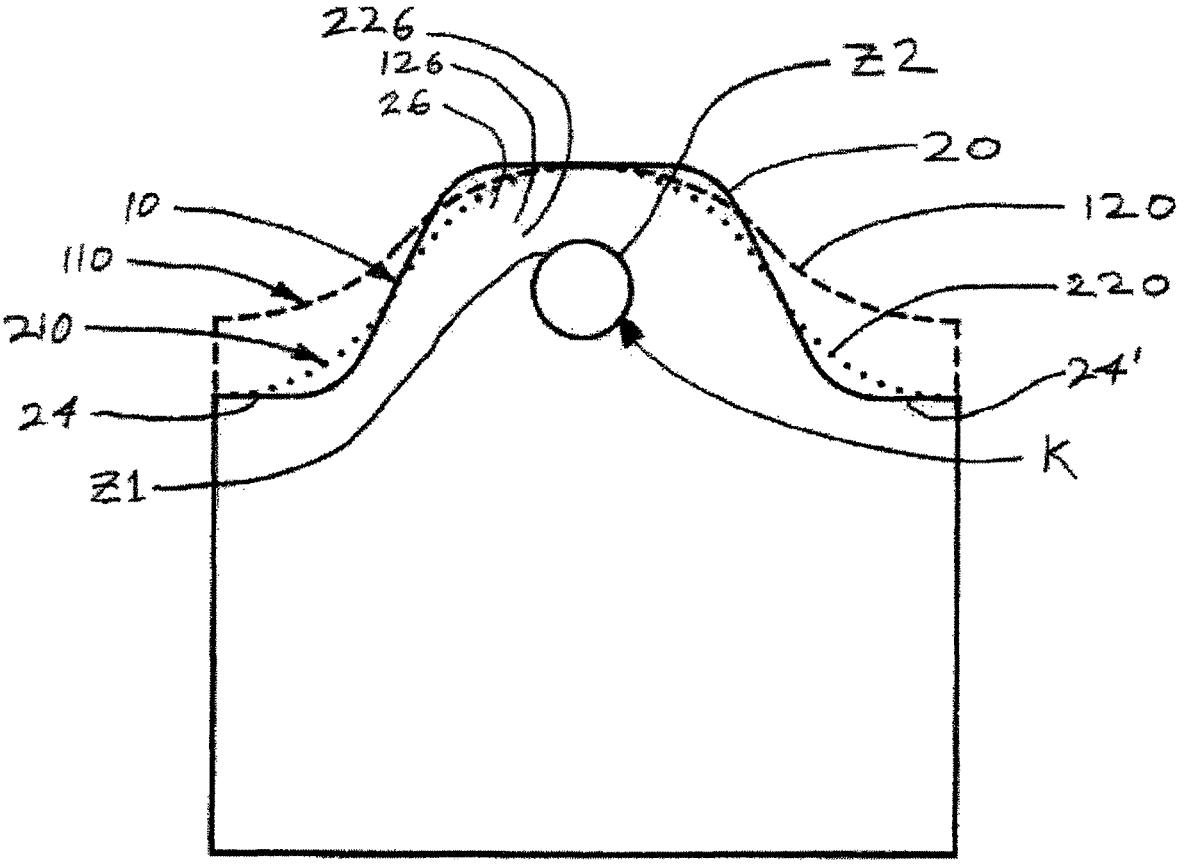
FIG. 3A is a front view of the exemplary embodiment shown in FIG. 2A, in enlarged scale and overlying the prior art bag in FIG. 1A and the prior art bag in FIG. 1C, comparing the respective upper portions, handle strength and foldability potential.
Figure 3A:
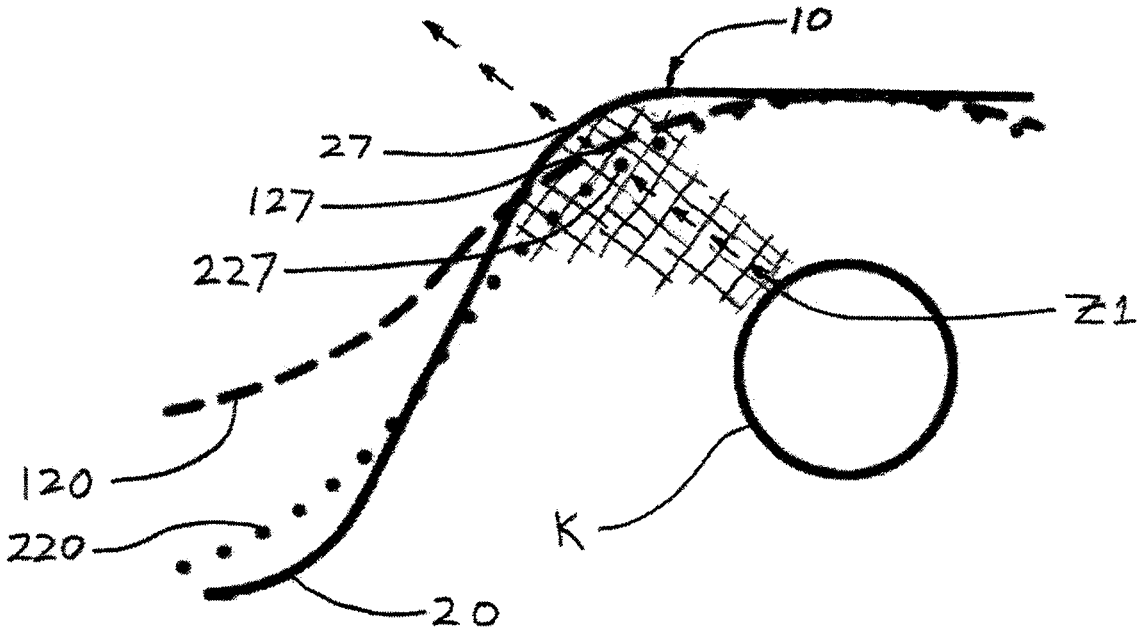

In FIGS. 3A and 3AA, three bag upper portions 120, 220, and 20 of the present invention of bags 110, 210, and 10, respectively, are overlaid, one atop the other with the same identical round handle K to better illustrate the superior handle strength of the upper portion structure of a bag constructed in accordance with the principles of the present invention, such as bag 10 shown in FIGS. 2A-2B for example. Upper portion 120 of a typical prior art sinusoidal wavetop bag 110 is similar to bag W in FIG. 1A, and; upper portion 220 of a typical prior art elongated wavetop bag 200, is similar to bag X in FIG. 1C, and; while upper portion 20 is that of a bag 10 constructed in accordance with the principles of the present invention as shown in FIGS. 2A and 2B, for example. In this description for the FIG. 3A comparison, the 100 series is used for reference numerals referring to prior art bag 110, the 200 series is used for reference numerals referring to prior art bag 210, and the 20s are used to refer to the bag 10 constructed in accordance with the principles of the present invention. All the bags 110, 210, and 10 illustrated are the same width with sinusoidal wavetop bag 110 being somewhat taller and would typically have a narrower bottom gusset. This upper portion overlay illustrates the amount (width) of film in the most critical, vulnerable regions (CVRs) 126, 226, and 26 of bag 110, bag 210, and bag 10 respectively, which regions are illustrated in blow-up FIG. 3AA and more or less follow a perpendicular path (dotted arrow line) from HSP Z1 (FIG. 3AA) outwards to their respective outer film edges 27, 127 and 227 and further identified by cross-hatched shading. In FIG. 3AA the three CVR locations of the three bags are measurable along the perpendicular dotted arrow lines. This precisely illustrates the location of where bag handles are subject to breakage when carrying heavier loads.

As illustrated in FIGS. 3A and 3AA, the plastic material at the vulnerable CVR location 26 of the bag 10 has the largest, widest amount of material. All things equal—film quality, bag dimensions, resin type, and so on—the upper portion and die-cut handles of the bag 10 are substantially stronger than the handles of the prior art bags 110 and 210. The practical structure of the bag 10 allows the bag 10 to have shorter handles that are stronger with superior utility, and require less raw material. As illustrated in this example and using a 19" wide bag, the width of the plastic film in the CVR location 26 of the present invention would be about 3", while in contrast, the 4" tall sinewave topped bag 110 would have a width of the plastic film in the CVR location of about 2½", and the width of the plastic film in the CVR location of the elongated sinewave topped bag 210 would be about 2¼". Thus, it can be said that handles on the bag 10 are about 20% stronger than shorter sinewave topped bag configurations (bag 110) and 33⅓% stronger than elongated wavetop bag configurations (bag 210). These comparisons are directly, and proportionally related to handle strength.

The overlay illustration in FIG. 3A also shows the basic structural differences of how the flattened shoulders 24 and 24' in upper portion 20 of a bag constructed in accordance with the principles of the present invention, such as bag 10 for example, are structured more conducive to allow the upper portion to fold down and out of the way more easily than the two upper regions 120 and 220 of prior art bags 110 and 210, respectively. As illustrated, the softly sloping upper portion 120 of bag 110 will not easily fold over. While the elongated upper portion 220 of bag 210 would tend to fold over more easily than bag 110, the handles are severely weakened at its CVR locations. Only the flattened shoulders 24 and 24' of the bag 10 promote the ability of the upper portion to fold over, and out of the way, all the while sustaining superior handle strength at the CVR locations. The value of the foldable upper portion to the trade is depicted in FIGS. 4A and 4B.

Figure 3B:
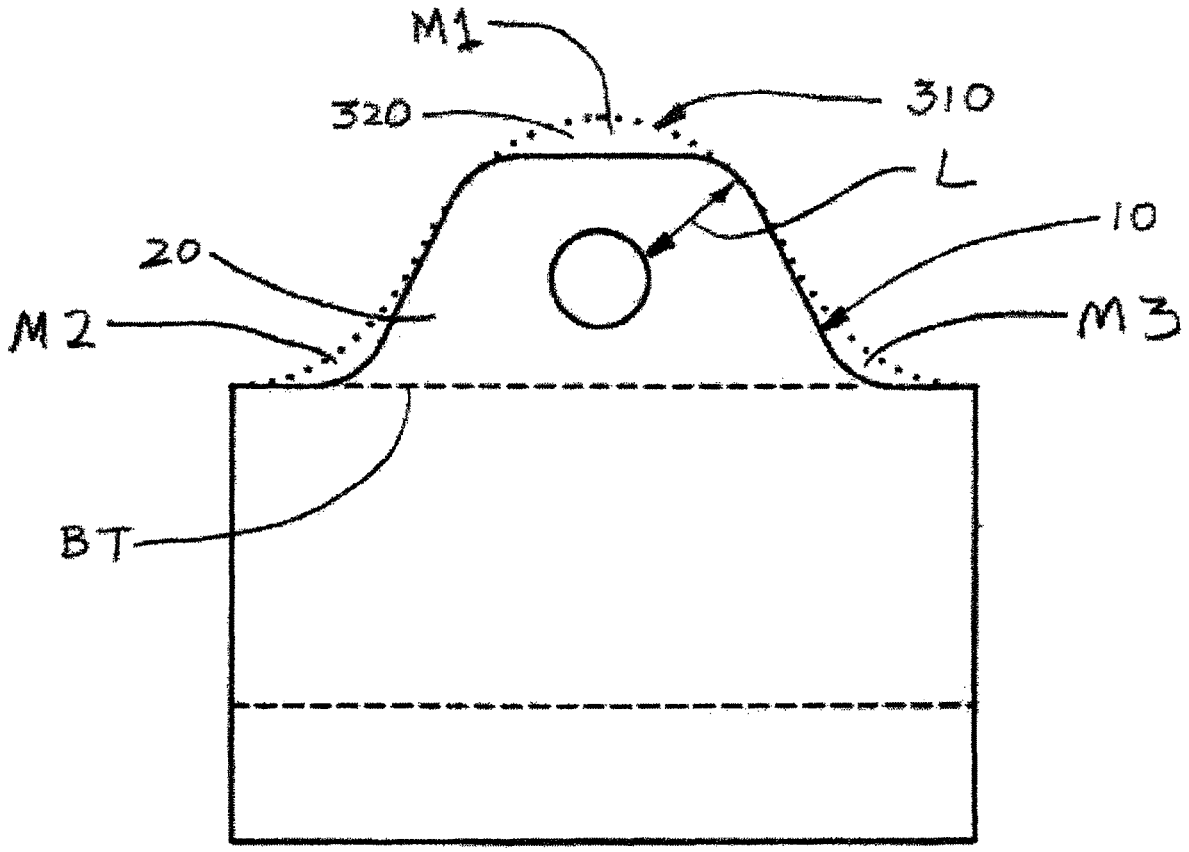
FIG. 3B is a front view of the exemplary embodiment shown in FIG. 2A, in enlarged scale and overlying a comparable sinewave bag with the handle shown in dotted outline, illustrating the requirements to have the same handle strength as a bag constructed in accordance with the principles of the present invention.

In FIG. 3B bag 10 is like that of the bag 10 in FIGS. 2A and 2B and bag 310 is an overlay of a traditional sinewave bag with the exact same holding capacity in its body. Bags 10 and 310 have the same die-cut handle size and location, with the same strength characteristics at the CVR locations (illustrated by the width at location L), and; which die-cut handle is in the same location sufficiently high enough above an identical body top BT such that the upper portions 20 and 320 would reach across and close together for carrying when the bags are fully loaded. It is a simple observation that bag 310 requires extra material in three locations M1, M2, and M3 in order to have the same superior handle strength attributes (in other words, CVR width) of the bag 10. This equates to the present invention having a raw material savings of at least 2.5%-5% and at times more, up to 10%, depending on bag configuration.

Figure 3C:
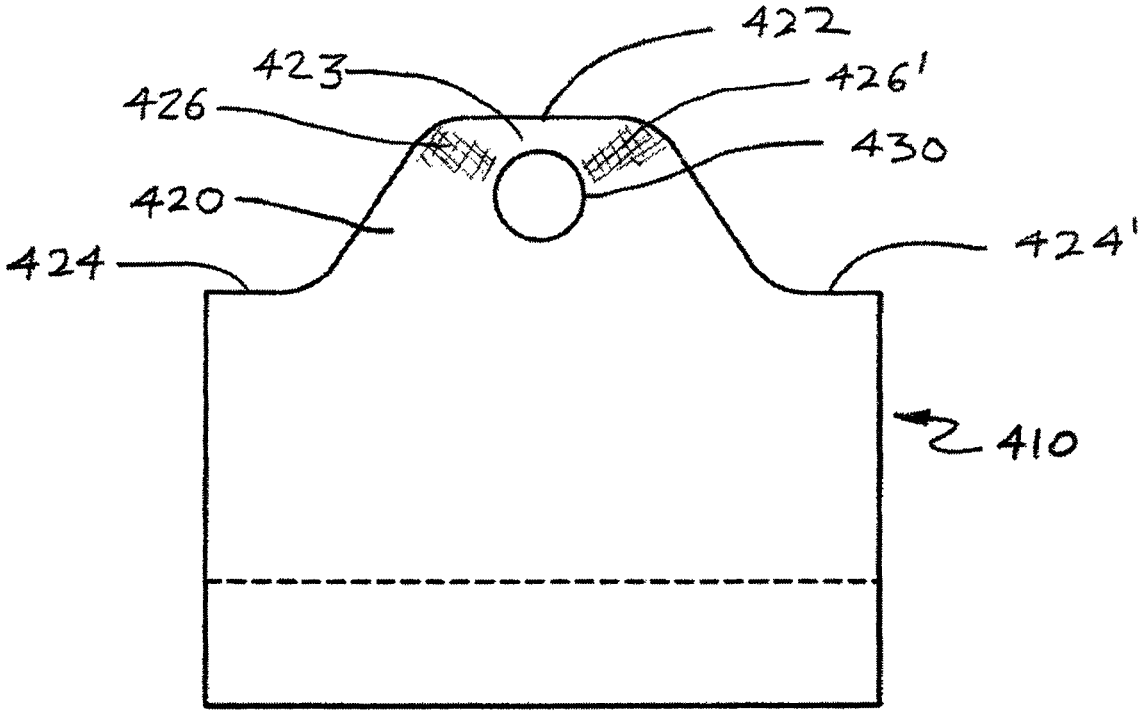
FIG. 3C is a front view of another exemplary embodiment of a plastic bag constructed in accordance with the principles of the present invention illustrating how the bag may be made with a lesser amount of raw material, the rear view being identical.

In FIG. 3C, bag 410 is much like that of bag 10 of FIG. 2A, however the top flattened upper portion 422 is further flattened with a narrower strip of material 423 above the top of the die-cut handle 430. Even with this narrow strip of film directly above the die cut handle 430, there is still sufficient plastic at the CVR locations at cross-hatched regions 426 and 426' in order to have strong carry handles. The upper portion 420 of bag 410 has foldability much like that of bag 10, with its flattened shoulders 424 and 424'. The CVR locations 426 and 426' may be slightly less in width than that of bag 10 of FIG. 2A since there is slightly less material at the CVR locations. This type of bag design may be more suitable for single-use bags and perhaps those uses that have consistently similar contents, such as a restaurant.

Figure 4A:
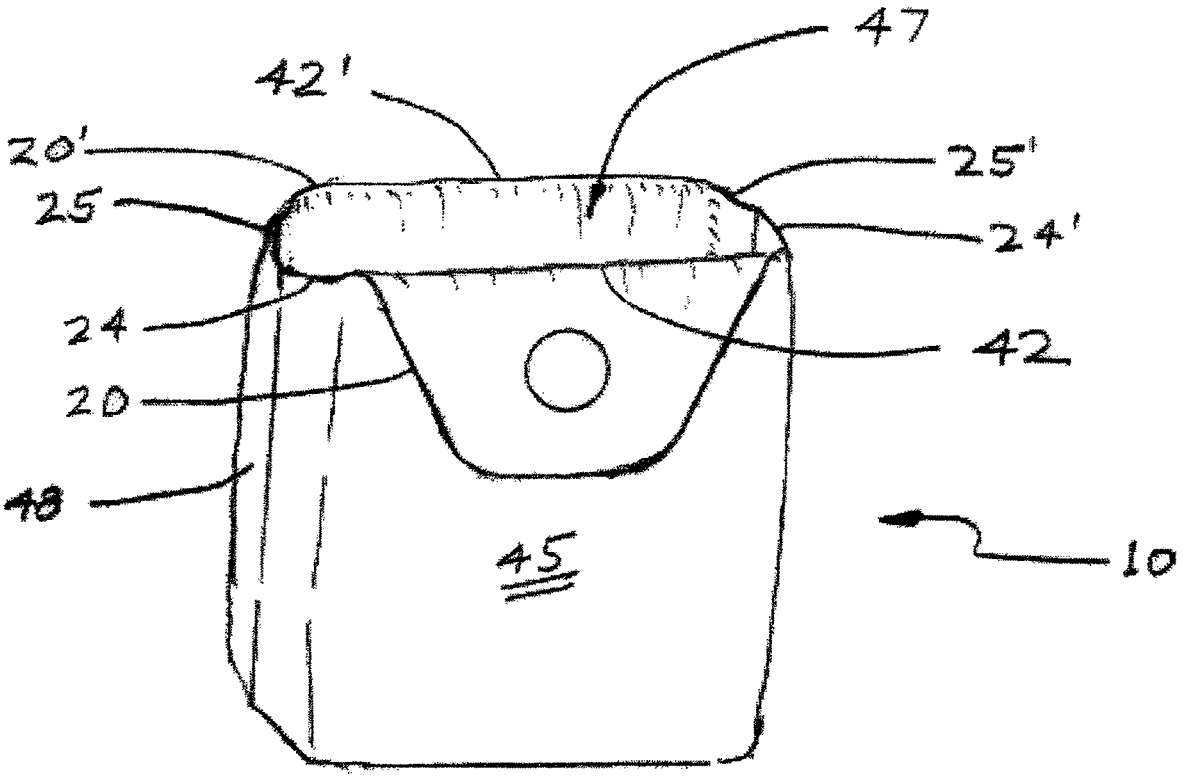
FIG. 4A is a perspective view of the exemplary embodiment of the bag shown in FIG. 2A with the bag handles folded down and out of the way.
Figure 4B:
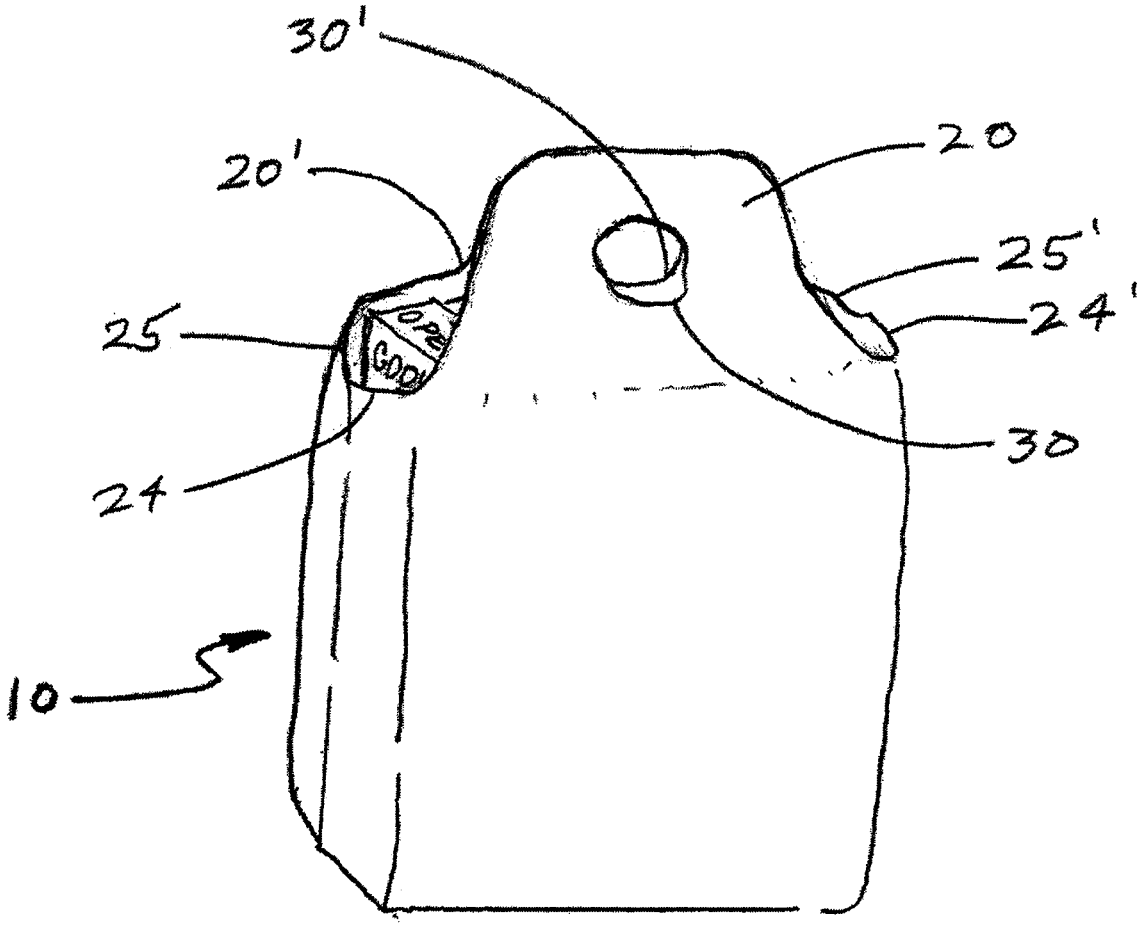
FIG. 4B is a perspective view of the bag in FIG. 4A loaded with goods, with die-cut handles meeting in the middle, and ready to be carried.

In FIG. 4A, bag 10 is the same as that of FIG. 2A and stands up in an open disposition with its two upper portions 20 and 20' folded over and out of the way exposing a large, clearly accessible bag mouth 47. This fold over operation is made possible due to the two flattened shoulders being of sufficient size as to induce, or initiate, the "folding out and over" of the upper portions 20 and 20'. As illustrated shoulders 24, 24' and 25 and 25', are parts of the two "cubed out" bag sides 48 and 48' (right side not shown but identical to left side 48). This cubing-out effect occurs more freely when the two adjacent shoulder pairs 24 and 25, and 24' and 25' are preferably at least one-half or more, of the width of the bottom gusset. It is the width of the bottom gusset that determines the size of the cubed-out bag sides 48 and 48' (right side, not shown). With this configuration, there is also a greater tendency for the upper portions 20, 20' to "flop outward", thus fall downward and out of the way of the open bag mouth and onto the respective front and rear surfaces of the bag 10 as illustrated. Generally speaking, the upper portions will fall down far enough so that the bag body tops 42 and 42' along front panel 45 and back panel 45' (not shown) are nearly level with the four outer flattened shoulders 24 and 24' and 25 and 25'. With prior art and its sinusoidal configuration, this type of stand-up bag operation is essentially impossible, or very difficult and time-consuming. At best, prior art bags would be able to initiate a fold over disposition, but the fold location will be above the top of the bag body where it tends to either interfere with bag loading, or the handles will collapse inward, inside the bag, which is undesirable. It is also interesting to note that the more a bag constructed in accordance with the principles of the present invention bag is reused, the easier, more willingly, and faster, the upper portions will fold over, standing up a bag for subsequent use.

There is an additional functional aspect of having the shoulders flattened in proper proportion to the bag bottom's size. That is, providing that any two adjacent flattened shoulders are about ½ or greater the size of the width of the bottom gusset, it tends to improve the bag's ability to "square out" on the bottom. While the use of prior art angle seals in bottom gussets is rather commonplace, angle seals used on bags constructed in accordance with the principles of the present invention with the angle seals produces a rather impressive, and very flat bag bottom. Finding a bag bottom is important to bag packers and their ability to fill goods flatly on the bottom (and to fill it out), so that when the bag is picked up to be carried by a user, the goods don't fall over. To a user, this also helps present a superior bag for transporting goods home and maintain its stand-up ability. Overall, the ability to stand up a bag constructed in accordance with the principles of the present invention with its foldable upper portions greatly simplifies the bag loading operation and subsequent use by users.

The size of the flattened shoulders may be somewhat shorter than indicated herein and still work fairly well, but optimum effectiveness is based on any two adjacent flattened shoulders being at least ½ the width of the bottom gusset. If substantially wider than ½ the bottom gusset width, then the upper portion may become too narrow and the stress lines forming between a bag's HSPs and the SRLs may actually cross over the upper portion's side edges, which would weaken the bag. Generally speaking, the steep middle outer edges cited in FIG. 2A are ideally parallel to two A-shaped stress lines as illustrated in FIGS. 1B and 2B.

In FIG. 4B, bag 10, as for example illustrated in FIGS. 2A, 2B, and 4A is loaded to the top with goods, and the upper portions 20 and 20' that were folded down and out of the way, are returned to an upward disposition, and convenient for a user to insert a single hand in die-cut handles 30 and 30' and carry the bag.

Figure 5:
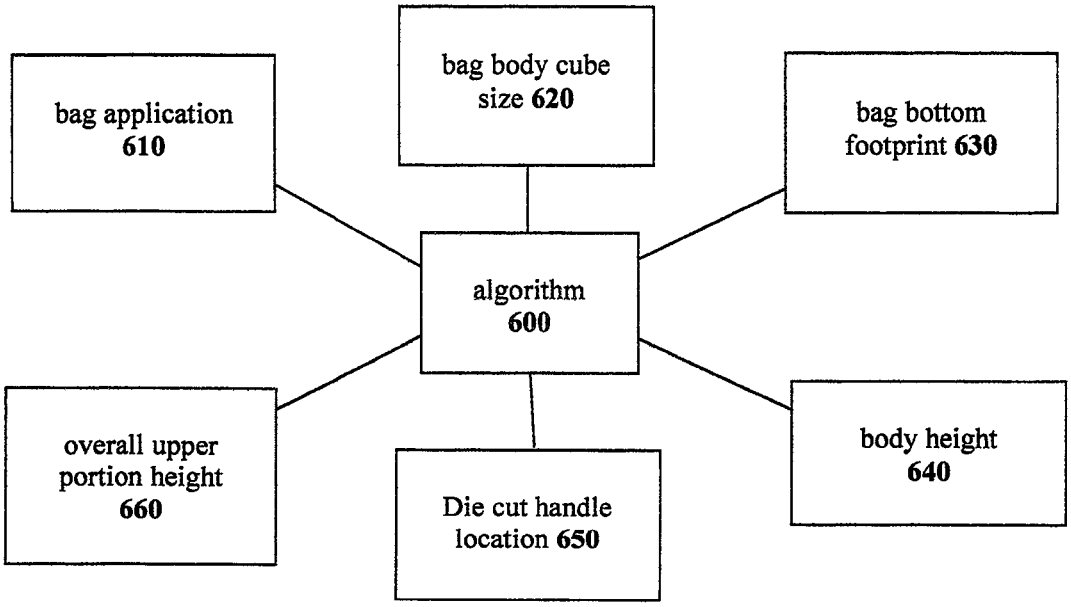
FIG. 5 is a block diagram illustrating an algorithm that provides a means to determine the bag size and proportions for any given bag constructed in accordance with the principles of the present invention, based on the application.

Bags made in accordance with an upper portion that have a wider band of plastic at the critical HSPs at the 10:00 and 2:00 locations may have a variety of applications and uses. At times, it may not be desirable for the upper portions to reach "all the way across", perhaps only part way. For example, with applications where it is understood that a bag may not be "filled to the top", for whatever reason(s), it may be desirable to have a shorter upper portion. It may in fact, even be used to prohibit a user from overfilling a bag (in order to maintain its usability). As will be explained in FIG. 5, the algorithm that determines the manufacturing specifications includes a variety of options; all of which intend to optimize bag functionality and performance for the specific application.

Bags constructed in accordance with the principles of the present invention may be made on machinery similar to that used to manufacture sinusoidal wavetop bags, but with four turns per upper portion instead of only two like with prior art sinusoidal wavetop bags. In using such machinery, it is desirable to have a specific approach to each bag application in order to optimize bag performance and at the same time, optimize manufacturing efficiencies. In block diagram 5, an algorithm 600 for producing a bag constructed in accordance with the principles of the present invention begins by first determining the bag application 610, then a bag body cube size 620 is calculated to accommodate the application and includes a bag bottom footprint 630 that becomes the bag bottom's dimensions, body height 640, die-cut handle location 650 relative to where they will meet above the contents, and last the overall upper portion height 660 determined by the strength requirements.

Generally speaking, bag application 610 usually comes from an end user who has specific requirements that may include determining a desired volume, or shape for goods to be loaded in the bag. It may also include certain weight strength, and/or rip and tear properties for the plastic film. The result of this first evaluation is to then calculate the desired bag body cube 620 that can suitably envelope, contain, the intended contents for the reasons desired. The bag cube 620 is first based on calculating a desired footprint 630 that will allow the contents to stand up, fill out, be stacked in a predetermined number of layers, capable of being loaded in a certain manner afterward, or perhaps mimic the sizing of some other bag application. For example, mimicking the size of a traditional paper grocery sack, which footprint measures 12" wide by 7" deep. Once the desired footprint is established, the next step is to determine an adequate body height 640, which usually consists of extending past the top of the contents by a predetermined distance, however far it may.

With the bag cube 620 now determined with a desired footprint 630 and a desired height 640, the next step is to determine how far above the front and rear bag walls, the die-cut handles ought to be located. This calculation is based on the specific location of the top of the die-cut handles where they will be used for carrying and the distance the two opposing handle tops will be required to span in order for them to have the desired utility. Throughout this discourse and the specifications, the illustrated handles have circular, round, at least on the upper half. The reason for this is because round handles, or those with a round upper half, are the strongest type of die-cut handles for plastic film. Alternative race track handles are the least desirable as they are vulnerable to breakage at the two outer, upward locations. The tight outer circle of a racetrack handle create a direct stress point in the worst possible locations, right at the HSPs at the 10:00 and 2:00 locations, which likewise is located closer to a bag top's outer edges creating a narrower CVR strips of film. In addition to round die-cut handles, those types with round upper halves like those described and shown in U.S. Pat. No. 5,338,118, which is hereby incorporated by reference, also have superior attribute that promote the largest amount of CVR material as possible. Thus, in this discourse, only those generally known in the trade as shapes with the strongest physical characteristics are used, albeit, the algorithm applies to all types, with the understanding that the bags still need to sustain the desired weight strength characteristics. For all practical purposes the actual locations of the two HSPs in a round die-cut handle would be located about ½" below the top of the die-cut handle, thus that dimensions is best included as a standard when making this calculation and added to the required distance. It will be appreciated that the algorithm disclosed herein for constructing bags with improved handle strength, carrying capacity, handle folding and stand-up ability take into account one or more preferred bag construction traits including, but not limited to, the size of bag bottom or footprint, the capacity of the bag, the intended use of the bag, the flattened shoulder lengths or widths, the flattened top length or width, the material used, the thickness of bag material, the gusset size and location, stress reception locations (SRLs), handle stress points (HSPs), and/or critical stress locations (CVRs), resulting in a preferred location of the handle within the upper portions of the bag.

One non-limiting example to illustrate a desired handle location 650 is to begin with a desired bag cube of 12"×7"×12" height, which has a bottom footprint of 12"33 7" (in the form of a bottom gusset), and can then be determined that if the bag is to be filled to the top of its 12" height, then the tops of the die-cut handles would be at the very least ½" the depth of the bottom gusset, plus one half inch. In this example, the handle tops would be located 4" (½ of 7"+½") above and beyond the 12" height of the body. A single hand inserted in the two die-cut handles would require stretching them to their extent across the 7" span. As a point of interest, once a hand is inserted into two die-cut handles and then carries a load of say 10 pounds, those handles will naturally stretch about an additional ½". Therefore, with this specific example, the formula ultimately works out to be one that provides for handles that can easily carry, and span the open bag mouth distance of a filled bag, and comfortably be carried in a single hand. For comfortably carrying goods as described herein, one exemplary reliable formula for ensuring the bag handles may be brought together and carried in one hand with the bag filled to capacity or less than capacity may be something like this: Die-cut handle top location (650)=½ the bottom gusset depth+½".

The last determinant for bags constructed in accordance with the principles of the present invention is to determine the overall upper portion height 660, which is based on the amount of plastic above the two HSPs on the die-cut handles and/or the top center of the die-cut handles. This added distance is primarily based on one of two factors: First, determine the handle strength requirements, and, second; if it is desirable to have the upper portion foldable. Handle strength requirements are based first on film type, thickness, and at times film orientation. Once the handle type and film properties are established, the next step is to add the extra amount of film required to have a CVR sufficient wide to carry the weight of the contents. Generally speaking different film types and grades will have different sets of measurements. The example to be used with the 12"×7"×12" cube bag with the HSTs extending 4" above the bag body top, and made for use as a reusable bag of a 2.25 mil thickness, would require a CVR measurement of 3" when used with reasonably high-quality film made from linear low density, high density, or a blend of the two resins. This measurement puts the amount of plastic located directly above the die-cut handle top center at about a 1¾" distance. Over time, a database will be filled up that automatically calculates these measurements, and a simple formula may be applied.

The second half of this calculation relies on whether or not the top center portion may be sufficiently flattened in order to allow the bag design to have shoulders that are large enough to promote foldability at the bag body's top edge. With the same example of the 12"×7"×12" cube bag body, an upper portion with a 3" CVR, the flat top portion could then safely be little as 1½" above the top center of the die-cut handle. In such a calculation, and based on the location of the perpendicular CVRs juxtaposed from the A-shaped stress lines (FIG. 2B), the flat linear bag top can be as long as 5", which converts to 2.5" shoulders, which in turn any two shoulders would then be greater than the depth of the bottom gusset (FIGS. 2B and 2C) and therefore, would provide excellent foldability.

Other variations on the theme of a desired algorithm may be somewhat the opposite. By starting with the height of the upper handled portion and making the HSPs a height equal to ½ of the bottom gusset width plus ½", and then providing a sufficient CVR strength width to reliably carry the desired load. Then determining the overall height of the upper portion, and moving backwards to create suitable shoulder measurements and so on. The versatility of applying the algorithm is not restricted solely the sequence of steps cited herein.

When determining the CVR dimensions, other factors play a part, such as, for example, whether the bags would be overloaded with goods that may stick out of the top of the bag. Other factors may include, but are not limited to, a determination of whether it is desirable to add an additional inch to the upper portion and die-cut handle location to carry an overloaded bag with a single hand or whether the uses are generally lighter weight, such as carrying 2-3 dinner containers from a restaurant.

Once the algorithm 600 is fully calculated manually or with assistance of a machine by the elected means, the only remaining element is to determine if a little extra consideration might be given to make the physical properties a bit stronger, or that might give the bag an appearance that might be perceived as a preferable.

As illustrated in the prior art patents discussed above in the Background, the approach used by plastic bag manufacturers to produce the prior art bags has been based on bag machinery specifications, production processes and efficiencies, frequently with little regard for a desired size based on functionality. Case in point is the large number of wavetop bags and imported loop handle bags used in the reusable bag market that have dimensions that make the bags difficult to load, and when loaded, the contents fall over. The prior art bag dimensions may have been suitable for use in foreign markets, or with soft goods, but trying to use the same dimensions for common grocery assortments is erroneous. In fact it is an attempt to force a manufacturing driven mentality into what ought to be a customer-driven application. It goes without saying the best approach for a reusable bag footprint ought to be based on the common, everyday paper grocery sack, which everyone knows how to load and whose contents have been tailored to fit inside for over 100 years.

Illustrating the folly of the manufacture-driven approach are plastic T-shirt style bags that have traditionally been made smaller and smaller as a means to lower the per unit price. Unfortunately, supermarkets end up using many more of the smaller bags, with an end result that usually raises overall costs, and increases labor. To confirm, a primary objective of the algorithm for constructing bags in accordance with the principles of the present invention is to disregard these types of manufacturing-driven and per unit price-driven shenanigans and correctly focus on the desired bag cube size and a usable capacity that correctly serves the intended objective among others, as further illustrated in FIG. 6.

Figure 6:
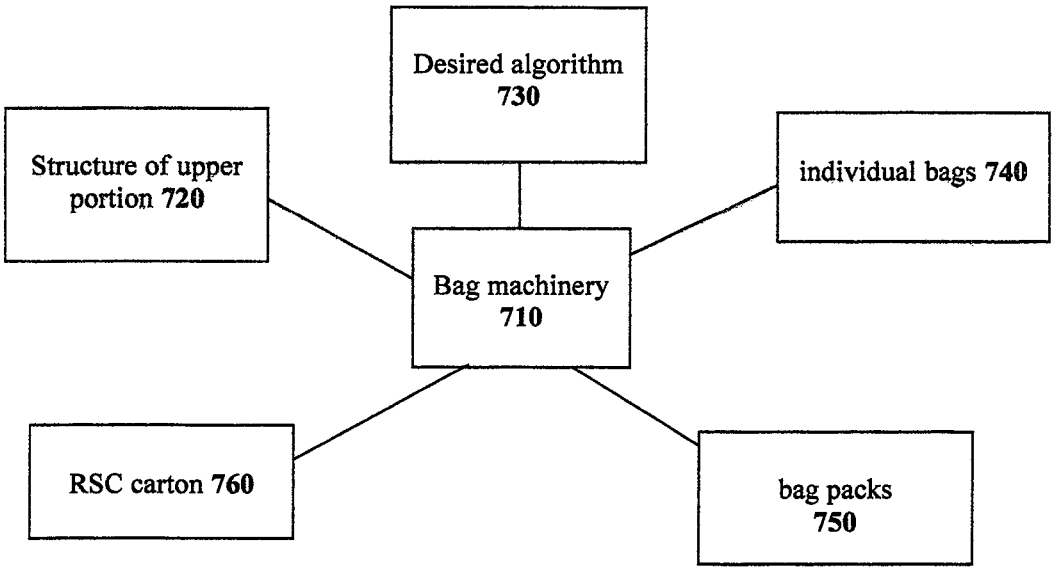
FIG. 6 is a block diagram illustrating the means of manufacturing the bags in accordance with the principles of the present invention.

In FIG. 6, bag machinery 710 automatically defines/cuts the structure of the upper portion 720 on a web of film based on a desired algorithm 730 and the upper portion dimensions, and; may be of an adjustable type that can handle the desired web sizes and repeat lengths. The machinery may use a flying knife or it may use a radial cutting drum, or elements of both. While a flying knife may have flexibility with size changes, the use of a radial drum may ultimately have higher, faster speeds, with a more reliable, consistent output. Therefore, a company with one or two fixed sizes may wish to have a radial bag making process that consistently manufactures the exact same bag size day in and day out. Regardless of how an upper portion 720 is formed, it would typically be done on some form of computer feed that governs the manufacturing processes. In such a manner, changeovers in sizing and styles may be quickly, efficaciously made and completed.

After defining the upper portion of a bag, it would then cut and seal them into individual bags 740. Further downstream, the individual bags would be stacked and assemble into bag packs 750 and may then be interconnected by a pressure and or die cutting operation, with the intention of creating self-opening bags for dispensing. Last the bag packs may be inserted into a dispenser carton, dispenser bag, or common RSC carton 760.

Regardless of the variations used to construct bags based on one or more elements and algorithmic methods taught in accordance with the principles of the present invention, there are specific benefits related to their use as illustrated herein. All in all, the benefits include, but are not limited to, stronger bag handles, bags that are easier to use; square-out, stand up, load, and carry afterward. Not limited to that is the reduction in raw material requirements to produce same-as quality, a better looking bag, and ultimately, one that can be made at low cost with very little scrap. Plastic bag manufacturers tend to be referred to as "pound farmers" and when a producer can cut raw material costs, even as little as 2%-3%, it represents a substantial profit increase. When the functionality of the bag with the lesser raw material is the preferred bag by users, these factors only add to the ease of marketing and selling same.

Consistent with the spirit of the present invention, bags made with an upper portion that has a wider band of plastic at the critical stress locations (CVRs) at the 10:00 and 2:00 locations, that may likewise cooperate in other ways to the bags performance may be made in accordance with the various individual features disclosed herein in accordance with the principles of the present invention or in combination and based on a manufacturing algorithm, and using various types of manufacturing methodologies. The spirit of the present invention provides a breadth of scope that includes all of these variations regardless of bag size, gauge, construction or upper portion configuration. It also covers broad methodologies of automating, partially or in whole, the algorithmic methods that produce bags that are configured based on the teachings of the present invention and various embodiments thereof. Any variation on the theme and methodology of accomplishing the same that are not described herein would be considered under the scope of the present invention.

Certain numerical ranges, capacities, and ratios have been mentioned in this description but are meant to be exemplary in nature and non-limiting.

Certain objects and advantages of the invention are described herein. Of course, it is to be understood that not necessarily all such objects or advantages may be achieved in accordance with any particular embodiment of the invention. Thus, for example, those skilled in the art will recognized that the invention may be embodied or carried out in a manner that achieves or optimizes one advantage or group of advantages as taught herein without necessarily achieving other objects or advantages as may be taught or suggested herein.

It is also contemplated that various combinations or sub-combinations of the specific features and aspects of the embodiments may be made and still fall within the scope of the invention. Accordingly, it should be understood that various features and aspects of the disclosed embodiments may be combined with or substituted for one another in order to form varying modes of the disclosed invention. Thus, it is intended that the scope of the present invention herein disclosed should not be limited by the particular disclosed embodiments described above.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

What is claimed is:

1. A top loading bag with improved carry handle strength and stand-up ability comprising:

a bag body including a front panel, a rear panel, a closed bag bottom preventing the insertion of objects into the bag body, and an open top defining a bag mouth through which objects may be loaded into the bag body, the bag body assuming a cubic self-standing configuration defining a flat bottom footprint and spaced apart front and rear panels when opened with the cubic self-standing configuration being based on a predetermined bag capacity; and a first upper bag portion extending upwardly from a top end of the front panel on one side of the bag mouth and a second upper bag portion extending upwardly from a top end of the rear panel on an opposing side of the bag mouth when the upper bag portions are in an upright extended carrying configuration, each upper bag portion further having a flat top middle edge with opposing outermost smooth curved sections that transition downwardly and outwardly into a pair of opposing left and right descending outwardly diverging straight edges with lowermost extents of the respective descending edges diverging away from one another and smoothly curving outwardly toward corresponding left and right opposing flat shoulders projecting outwardly at the same height relative to the bag bottom when the upper bag portions are in the upright extended carrying configuration, each upper bag portion further having a carry handle with a handle aperture having a lowermost extent disposed above a line passing through the opposing flat shoulders and an uppermost extent disposed below the flat top middle edge when the handles are in the upright extended carrying configuration, the left and right opposing flat shoulders urging their respective upper bag portions to fall outwardly away from one another and the bag mouth and toward the exterior surface of their respective front and rear panels when the bag body assumes the cubic self-standing configuration.

2. The bag of claim 1 wherein:

the closed bag bottom has two edges defining an expandable bottom gusset therebetween that defines the flat bottom footprint when filled with the volume of contents.

3. The bag of claim 1 wherein:

the upper bag portions are connected seamlessly with their respective front and rear panels with the front upper bag portion being of the same single ply and having the same uniform thickness as the front panel and the rear upper bag portion being of the same single ply and having the same uniform thickness as the rear panel; and one or more handle stress points are located within the single ply of the upper bag portions to cooperate with one or more stress reception locations on a portion of the same single ply disposed on a panel proximate the bag bottom to increase a carrying capacity of the bag body.

4. The bag of claim 1 wherein:

in an open loading configuration, the bag body defines a cubic shape with the flat bottom footprint and the front and rear panels cooperating to support the bag body in the self-standing configuration from a horizontally flat support surface with the bag mouth in an open disposition facing upwards through which loading may occur with the upper bag portions fold away from one another and the bag mouth and down toward a portion of an exterior surface of their respective front and rear panels to dispose the front handle aperture below the front panel shoulders and proximate the front panel and the rear handle aperture below the rear panel shoulders and proximate the rear panel.

5. The bag of claim 1 wherein:

any two flat shoulders are equal in length to any one flat top middle edge on a front or rear panel.

6. The bag of claim 2 wherein:

the flattened shoulders are preferably one-fourth to one-half the width of the bottom gusset.

7. The bag of claim 2 wherein:

the two adjacent shoulder pairs are at least one-half, or more, of the width of the bottom gusset.

8. The bag of claim 1 wherein:

the handle aperture of each upper bag portion is circular and is located with an uppermost region of the handle aperture a distance predetermined prior to construction below the flat top middle edge and a lowermost region of the handle aperture a distance predetermined prior to construction above a plane passing through the opposing flat shoulders on the associated front or rear panel when the handles are in the upright extended carrying configuration; and a set of at least two handle stress points are located within an enlarged portion of the corresponding upper bag portion adjacent each handle aperture at approximately a ten o'clock position and a two o'clock position relative to a smaller portion located at the twelve o'clock position to cooperate with a set of stress reception locations proximate the bag bottom through a single ply of a respective front or rear panel of the bag body to optimize the handle strength of the bag.

9. The bag of claim 1 wherein:

the opposing descending edges of the upper bag portions are substantially parallel to a set of stress lines passing through at least one panel proximate the bag bottom and extending to the ten o'clock or two o'clock positions relative to the center of the handle aperture.

10. The bag of claim 1 wherein:

the bag is constructed with an uppermost extent of a set of aligned front and rear handle apertures above the upper end of the bag body and overall upper bag portion height to meet a set of bag requirements based on an algorithm factoring in a bag application and a bag body cube size indicative of a bag capacity based on a bag footprint and a bag body height.

11. The bag of claim 1 wherein:

the uppermost smooth curve to the left of the flat top is positioned at an approximate ten o'clock position relative to the center of the handle aperture and the uppermost smooth curve to the right of the flat top is positioned at an approximate two o'clock position relative to center of the handle aperture.

12. The bag of claim 1 wherein:

a set of stress lines passing through at least one panel proximate the bag bottom and extending to the ten o'clock and the two o'clock position relative to the handle aperture converge toward opposing sides of the handle aperture diverge away from one another beneath the handle aperture.

13. The bag of claim 1 wherein:

the height of the upper bag portions, the location of the uppermost extent of the handle apertures relative to the flat top middle edge, and the distance between the opposing outermost smooth curved sections and a corresponding proximate region of the handle aperture are constructed according to an algorithm based on the cube size of the bag body, a predetermined weight requirement, and a predetermined strength requirement that results in the set of opposing carry handles cooperating to carry a predetermined volume of contents when placed within the bag body.

14. The bag of claim 1 wherein:

the upper bag portions project seamlessly from their respective panels.

15. The bag of claim 1 wherein:

the bag body, the upper bag portions, and the closed bag bottom are reusable.

16. The bag of claim 1 wherein:

the width of at least one upper bag portion between a two o'clock position relative to the center of the handle aperture and the closest point on an adjacent outermost smooth curved section is greater than the width of the at least one upper bag portion between a twelve o'clock position relative to the center of the handle aperture and the closest point within the flat top middle edge.

17. The bag of claim 1 wherein:

the width of at least one upper bag portion between a ten o'clock position relative to the center of the handle aperture and the closest point on an adjacent outermost smooth curved section is greater than the width of the at least one upper bag portion between a twelve o'clock position relative to the center of the handle aperture and the closest point within the flat top middle edge.

18. The bag of claim 1 wherein:

the width of both upper bag portions between a two o'clock position relative to the center of the handle aperture and the closest point on an adjacent outermost smooth curved section is greater than the width of both upper bag portions between a twelve o'clock position relative to the center of the handle aperture and the closest point within the flat top middle edge; and the width of both upper bag portions between a ten o'clock position relative to the center of the handle aperture and the closest point on an adjacent outermost smooth curved section is greater than the width of both upper bag portions between a twelve o'clock position relative to the center of the handle aperture and the closest point within the flat top middle edge.

19. A top loading bag with improved carry handle strength and stand-up ability comprising:

a bag body including a front panel and a rear panel sealed together at their respective side edges with a closed bag bottom with a folded gusset to define a flat bag configuration with the panels abutting, the bag body further being constructed to assume a self-standing cubic shape with spaced apart front and rear panels when opened and the gusset expanded resulting in a flat bottom footprint with the bag bottom preventing the insertion of objects into the bag body and an open top defining a bag mouth through which objects may be loaded into the cubically shaped self-standing bag body; and a first upper bag portion extending upwardly from a top end of the front panel on one side of the bag mouth and a second upper bag portion extending upwardly from a top end of the rear panel on an opposing side of the bag mouth when the upper bag portions are in an upright extended carrying configuration, each upper bag portion further having a flat top middle edge with opposing outermost smooth curved sections that transition downwardly and outwardly into a pair of opposing left and right descending outwardly diverging straight edges with lowermost extents of the respective descending edges diverging away from one another and smoothly curving outwardly toward corresponding left and right opposing flat shoulders projecting outwardly at the same height relative to the bag bottom and terminating at the uppermost point of their adjacent sealed side edges of the bag body, each upper bag portion further defining a carry handle with a handle aperture having a lowermost extent disposed above a line passing through the opposing flat shoulders and an uppermost extent disposed below the flat top middle edge when the upper bag portions are in the upright extended carrying configuration, both of the upper bag portions being disposed outwardly away from one another and the bag mouth and toward the exterior surface of their respective panels when the bag body is opened and assumes a self-standing cubic shape.

20. The method of using a bag with improved carry handle strength and stand-up ability comprising:

providing a bag with a bag body including a front panel and a rear panel sealed together at their respective side edges, a closed bag bottom with a folded gusset preventing the insertion of objects into the bag body, and an open top defining a bag mouth through which objects may be loaded, the bag further including a first upper bag portion extending from a top end of the front panel on one side of the bag mouth and a second upper bag portion extending from a top end of the rear panel on an opposing side of the bag mouth, each upper bag portion having a flat top middle edge with a pair of opposing outermost smooth curved sections that transition into a pair of opposing left and right outwardly diverging straight edges with their extents diverging away from one another and transitioning into corresponding left and right opposing flat shoulders that project outwardly and at the same distance from the bag bottom and terminating at an uppermost point of their adjacent sealed side edges of the bag body, each upper bag portion further having a carry handle with a handle aperture having a lowermost extent disposed above a line passing through the opposing flat shoulders and an uppermost extent disposed below the flat top middle edge when the carry handles are in an upright extended carrying configuration;

presenting one or more bags in a flat stack;

pulling a first upper bag portion away from an adjacent upper bag portion of an uppermost bag of the flat stack to expand the folded gusset until the bag body enters into a cubic shape with a flat bottom;

placing the cubically shaped bag body onto a flat horizontal support surface; and providing space around the cubically shaped bag allowing the first upper bag portion and the adjacent upper bag portion to fall outwardly away from one another and the bag mouth about their respective opposing flat shoulders and toward the exterior surface of their respective panels to present an unobstructed wide open bag mouth ready for loading.

* * * * *